US005612594A

United States Patent [19]

Maheshwari

[11] Patent Number: 5,612,594

[45] Date of Patent: Mar. 18, 1997

[54] ELECTRONIC DIMMING BALLAST FEEDBACK CONTROL SCHEME

[75] Inventor: Ajay Maheshwari, Dallas, Tex.

[73] Assignee: C-P-M Lighting, Inc., San Leandro, Calif.

[21] Appl. No.: 528,508

[22] Filed: Sep. 13, 1995

[51] Int. Cl.[6] ..... H05B 37/02

[52] U.S. Cl. ..... 315/224; 315/291; 315/307; 315/209 R; 315/DIG. 5; 315/DIG. 7

[58] Field of Search ..... 315/209 R, 219, 315/224, 229, 235, 291, 307, 171, 176, DIG. 4, DIG. 5, DIG. 7

[56] References Cited

U.S. PATENT DOCUMENTS

| | | | |
|---|---|---|---|
| 4,251,752 | 2/1981 | Stolz | 315/206 |
| 5,001,386 | 3/1991 | Sullivan et al. | 315/219 |
| 5,041,763 | 8/1991 | Sullivan et al. | 315/176 |
| 5,066,894 | 11/1991 | Klier | 315/224 |
| 5,144,205 | 9/1992 | Motto et al. | 315/244 |
| 5,173,643 | 12/1992 | Sullivan et al. | 315/276 |
| 5,245,253 | 9/1993 | Quazi | 315/224 |
| 5,331,253 | 7/1994 | Counts | 315/209 R |
| 5,424,614 | 6/1995 | Mahoshwari | 315/209 R |
| 5,461,287 | 10/1995 | Russell et al. | 315/209 R |

OTHER PUBLICATIONS

A. Okude, "Development of an Elecytronic Dimming Ballast . . . ", Journal of Ill. Eng. Soc., Winter 1992.

*Primary Examiner*—Robert Pascal
*Assistant Examiner*—Haissa Philogene
*Attorney, Agent, or Firm*—Thomas E. Schatzel; Law Offices of Thomas E. Schatzel A Prof. Corporation

[57] ABSTRACT

A dimmable fluorescent lamp system comprises a fluorescent lamp with filaments at each end that are continuously heated by a transformer. A resonating capacitor is connected in series with a resonating inductor and a pair of DC blocking capacitors are connected from each end of the fluorescent lamp to put it in parallel with the resonating capacitor. A control logic drives the resonating inductor with a pulse-width modulated square wave that is controlled by a feedback voltage derived from a pair of rectifiers and a dropping resistor in series with one of the DC blocking capacitors. An error amplifier with two gain settings, e.g., one for a range of 0–20% of maximum light dimming and the other for 20%–100% dimming, compares the feedback voltage to a setpoint. A threshold comparator establishes the switchover point between the two error gain ranges.

5 Claims, 1 Drawing Sheet

ELECTRONIC DIMMING BALLAST FEEDBACK CONTROL SCHEME

BACKGROUND OF THE INVENTION

1. Field of the Invention

The present invention relates generally to fluorescent lamps, and more specifically to lamp systems with wide-range dimming adjustments.

DESCRIPTION OF THE PRIOR ART

Fluorescent lamps provide high efficiency operation and long life. However, fluorescent lamps require ballasts that convert the operating voltages and regulate the current delivered to the lamps themselves. Traditional ballasts have only offered on and off operation, fluorescent lamps with dimming capability have been rare. Electronic ballasts with dimming capability form the basis of highly efficient energy and lighting management systems. Conventional lamp systems with dimming ranges that can go as low as 20% of the maximum light output use both magnetic and electronic dimming ballasts. High frequency electronic ballasts have extended the lower dimming range limit to as low as one percent of maximum and are becoming increasingly affordable and popular. Essentially, fluorescent dimming circuits control the lamp current.

Because fluorescent lamps have very nonlinear electrical characteristics, such dimming controls are not as simple as they are for incandescent lamps which require only simple variable resistors, for example. Dimming down to twenty percent with conventional fluorescent lamp ballasts can be done without using a special feed-back control. However, for more extended lower dimming ranges, some sort of feed-back control becomes necessary to avoid lamp flicker and unstable lamp operation. Lamp power and lamp current are each typically used as control variables in the implementation of a feed-back control circuit. Where the lamp light output or lamp power is used as the control variable, the dimming range that can be realized is limited. For very extended low-end dimming levels, sensing the lamp arc current becomes essential.

Dimming operation requires that the lamps be operated with their filaments heated. Each filament at the respective lamp ends will draw a heating current and an arc current that flows between the filament ends when a sufficiently high voltage is applied.

The fluorescent lamp arc current is a differential current between the filaments that can be measured by a current transformer in series with the high voltage supply. In conventional dimming ballasts, the output voltage of such a current transformer is rectified and converted to a DC voltage that is proportional to the arc current. The DC voltage is used in a feedback control to regulate the arc current. The ratio of full-bright current at maximum light output and full-dim current at minimum light output typically ranges from 20:1 to 100:1, depending on the fluorescent lamps and ballasts used. Often the feedback voltages that represent the full-dim current become too small to rectify from AC to DC and require more complex and elaborate conversion circuitry. Precision current transformers themselves are relatively expensive and the overall cost of conventional current sensing becomes prohibitive.

U.S. Pat. No. 5,424,614 for "Modified Half-Bridge Parallel-Loaded Series Resonant Converter Topology For Electronic Ballast," describes an output topology that enables the sensing of lamp arc current without adding magnetic components (current transformers) or any elaborate circuitry. Such application is incorporated herein by reference.

SUMMARY OF THE PRESENT INVENTION

It is therefore an object of the present invention to provide a dimmable fluorescent lamp system.

It is a further object of the present invention to provide a dimmable fluorescent lamp system with a wide stable range of light dimming.

Briefly, a dimmable fluorescent lamp system embodiment of the present invention comprises a fluorescent lamp with filaments at each end that are continuously heated by a transformer. A resonating capacitor is connected in series with a resonating inductor and a pair of DC blocking capacitors are connected from each end of the fluorescent lamp to put it in parallel with the resonating capacitor. A control logic drives the resonating inductor with a pulse-width or frequency modulated square wave that is controlled by a feedback voltage derived from a pair of rectifiers and a dropping resistor in series with one of the DC blocking capacitors. An error amplifier with two gain settings, e.g., one for a range of 0%–20% of maximum light dimming and the other for 20%–100% dimming, compares the feedback voltage to a setpoint. A threshold comparator establishes the switchover point between the two error gain ranges.

An advantage of the present invention is that a dimmable fluorescent lamp system is provided that is stable in operation.

Another advantage of the present invention is that a fluorescent lamp system is provided that has a wide range of light dimming.

These and other objects and advantages of the present invention will no doubt become obvious to those of ordinary skill in the art after having read the following detailed description of the preferred embodiment which is illustrated in the drawing figure.

IN THE DRAWING

FIG. 1 is a schematic diagram of a fluorescent lamp system embodiment of the present invention.

DETAILED DESCRIPTION OF THE PREFERRED EMBODIMENT

Figure 1:
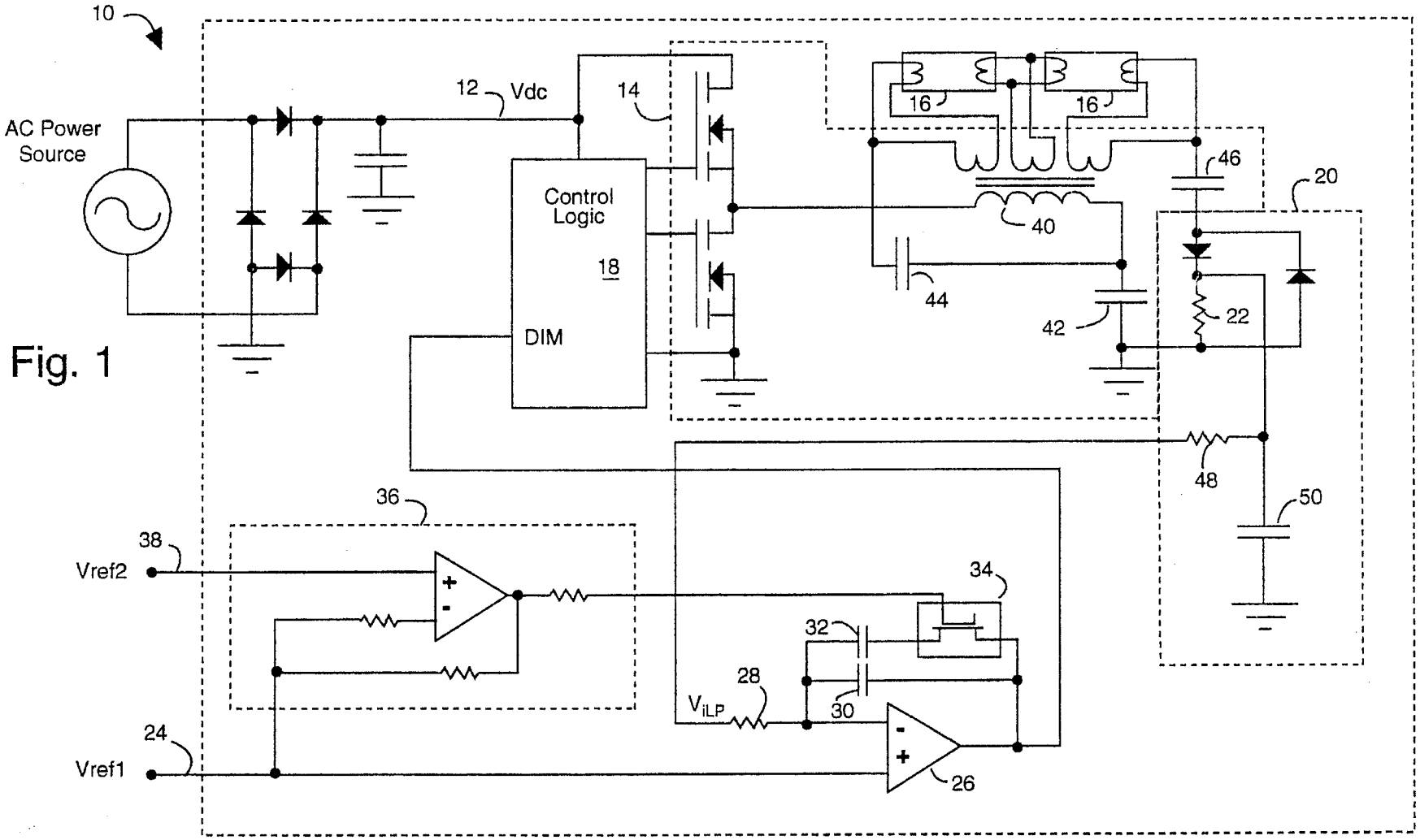
Figure 1:
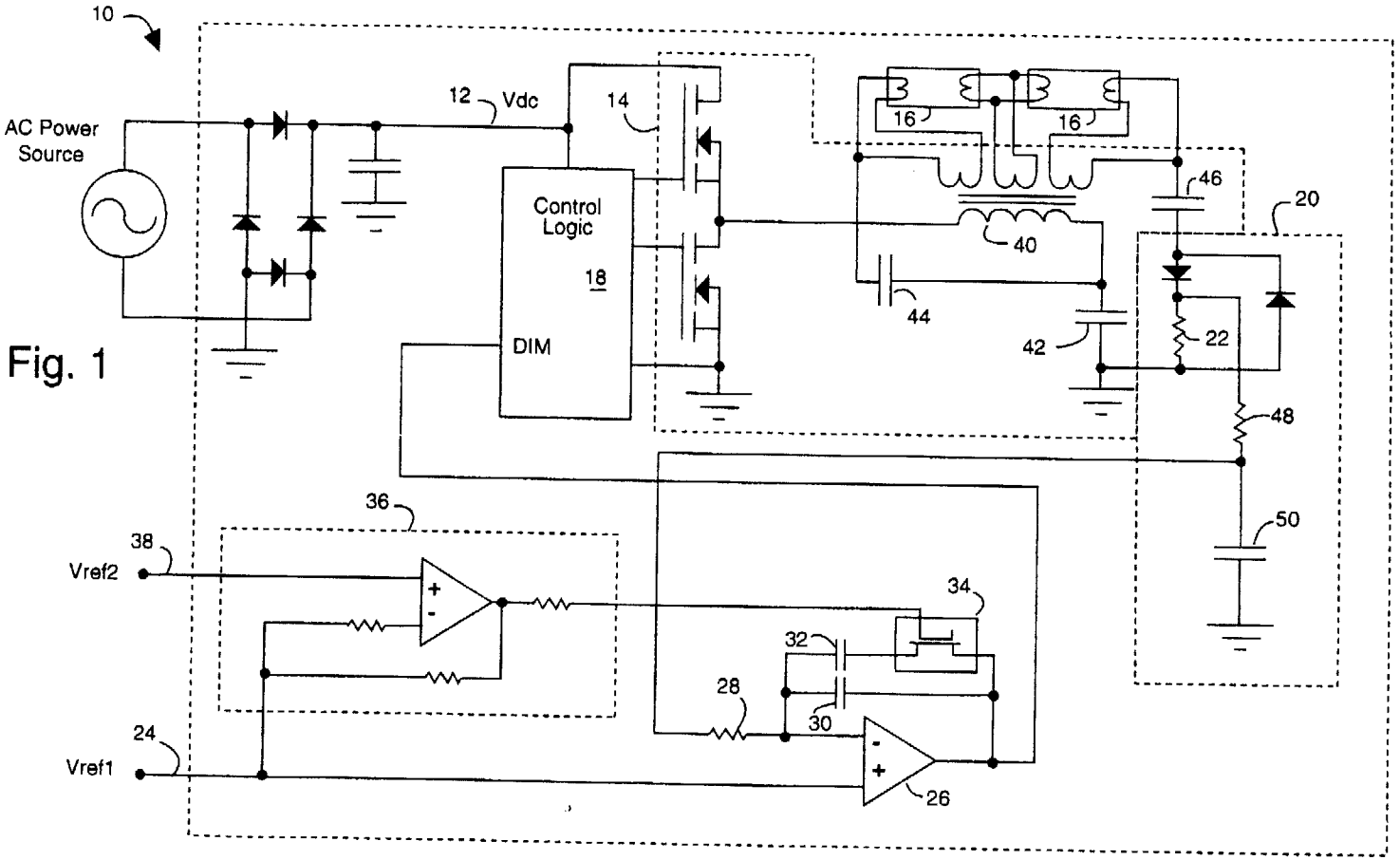

FIG. 1 illustrates a dinunable fluorescent lamp system embodiment of the present invention referred to herein by the general reference numeral 10. A DC supply rail (Vdc) 12 represents a lamp ballast power source that is typically generated by rectifying the AC line and regulating it with a boost converter. An inverter 14 is the output stage of the lamp ballast, and converts the Vdc to a high-frequency AC voltage, enough to ignite a lamp 16. A pulse-width modulator or frequency controller 18 is used to control the inverter 14. In order to establish dimming control, the current from the lamp 16 is connected to a current sensor 20. A resistor 22 converts such current to a low voltage DC signal ($V_{iLP}$) that is proportional to the lamp current.

A voltage reference ($V_{REF1}$) from an input 24 establishes a desired dimming level, e.g., a control setpoint. The voltage equivalent of the lamp current ($V_{iLP}$) is subtracted from the dimming reference ($V_{REF1}$) by an error amplifier 26 to produce an error signal. The error signal goes more positive when the lamp current is less than the setpoint level. And it goes less positive when lamp current is higher than the setpoint level. Such error information in the form of a positive DC voltage signal is used to adjust the duty cycle or frequency of the controller 18, which in turn makes changes in the drive to the inverter 14 that ultimately affects the lamp current. Ideally, the difference between ($V_{iLP}$) and ($V_{REF1}$) automatically approaches zero. A compensation network, comprised at its simplest of a resistor 28 and a pair of capacitors 30 and 32 with a switch 34 in series with capacitor 32, are provided for the error amplifier 26. The exact values of these components must be empirically derived for particular applications. A switch control logic 36 is connected to a switch-over reference voltage ($V_{REF2}$) input 38 to control the switch 34.

The compensation network of resistor 28 and capacitors 30 and 32 should present impedance values that properly damp the control response of the error amplifier 26 over the whole of the dimming control range. The switch 34 provides for two gain settings, a higher one when capacitor 32 is switched out, and a lower one when switch 34 is closed. Higher gain is typically needed in the lower light dimming range. Too much gain in the upper light dimming range, e.g., above 20%, would make the control system unstable. The switch-over reference voltage ($V_{REF2}$) input 38 sets the point at which the gain of error amplifier 26 changes by action of the switch 34 being opened and closed. Closing the switch 34 places capacitor 32 in parallel with capacitor 30, and thus decreases the closed-loop gain of the amplifier 26. The logic 36 provides some hysteresis to prevent threshold jitter.

In FIG. 1, the inverter 14 includes a transformer 40 with a primary winding that functions as a resonating inductor. A resonating capacitor 42 and the resonating inductor form a resonant circuit across which very high voltages can be developed at the resonant frequency. DC blocking is provided by a pair of capacitors 44 and 46. Although only one DC blocking capacitor is strictly necessary for operation, two provide isolation that improves user safety.

In alternative embodiments, the current sensor 20 may include filtering in the form of a resistor 48 and a capacitor 50. Signals to control inputs 24 and 38 can be implemented with potentiometers connected across a reference source.

Alternatively, such signals may be developed remotely.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A dimmable fluorescent lamp system, comprising:

a ballast assembly with at least one fluorescent lamp connected to a power inverter for igniting the lamp with high-frequency AC power derived from a DC source and controlled by at least one of a pulse-width modulator or frequency controller that effect a lamp current ($I_{LAMP}$) that passes through the lamp during operation;

sensing means connected to said power inverter for sensing said lamp current ($I_{LAMP}$);

error amplification means with a plurality of fixed gain control settings and connected to receive a feedback signal from the sensing means and a dimming setpoint signal, and connected to control said pulse-width modulator or frequency controller such that said feedback signal and setpoint signal automatically have a near zero error; and range control means connected to change said gain control settings of the error amplification means in response to the operation of said dimming setpoint within particular ranges.

2. The system of claim 1, wherein the ballast assembly comprises:

a first fluorescent lamp with first and second filaments at respective opposite ends for continuous heating;

a resonating inductor with first and second ends;

a resonating capacitor with first and second ends connected in series with said second end of the resonating inductor; and a connection from said first filament to a junction of said second end of the resonating inductor and said first end of the resonating capacitor.

3. The system of claim 2, wherein the sensing means comprises:

a dropping resistor and a first rectifier connected in series with a DC blocking capacitor between said second filament and said second end of the resonating capacitor with a second rectifier connected with opposite polarity across said dropping resistor and said first rectifier, wherein a feedback voltage is developed across said dropping resistor that is proportional to an arc current flowing through the fluorescent lamp between said first and second filaments.

4. The system of claim 3, wherein:

said pulse-width modulator or frequency controller include a control logic connected to receive said feedback voltage from said dropping resistor and connected to drive said first end of the resonating inductor with a pulse-width or frequency modulated square wave that is controlled over a dimming range by said feedback voltage.

5. The system of claim 4, further comprising:

a second fluorescent lamp connected in series with the first fluorescent lamp and having heating filaments in opposite ends; and a transformer having secondary winding means for heating said filaments in the first and second fluorescent lamps;

wherein a single arc current flows through the series combination of the first and second fluorescent lamps and said dropping resistor and providing for a dimming control of both the first and second fluorescent lamp.

* * * * *

UNITED STATES PATENT AND TRADEMARK OFFICE

CERTIFICATE OF CORRECTION

PATENT NO. : 5,612,594

DATED : March 18, 1997

INVENTOR(S) : Ajay Maheshwari

It is certified that error appears in the above-indentified patent and that said Letters Patent is hereby corrected as shown below The position of resistor 48 should be placed as indicated in the drawing as per attached sheet:

Signed and Sealed this

Seventeenth Day of June, 1997

*Attest:*

*Attesting Officer*

BRUCE LEHMAN

*Commissioner of Patents and Trademarks*